US006073393A

United States Patent [19]

Gutsche

[11] Patent Number: 6,073,393

[45] Date of Patent: Jun. 13, 2000

[54] ELEMENTS FOR A PLANT CONTAINER

[76] Inventor: Gunter Emil Gutsche, 4476 Forget, Terrebonne, Quebec, Canada, J6X 1Z4

[21] Appl. No.: 09/037,279

[22] Filed: Mar. 9, 1998

[51] Int. Cl.[7] ..... A01G 9/02; A01G 31/02; A47G 7/02

[52] U.S. Cl. ..... 47/67; 47/65.8; 47/66.6

[58] Field of Search ..... 47/67, 75, 65.8, 47/65.7, 65.5, 66.6

[56] References Cited

U.S. PATENT DOCUMENTS

| | | | |
|---|---|---|---|
| D. 239,192 | 3/1976 | Wiles | D35/3 A |
| D. 259,712 | 6/1981 | Heydenreich | D11/2 |
| 470,437 | 3/1892 | McElhiney | 47/67 |
| 1,572,548 | 2/1926 | Mattison | 47/67 |
| 2,956,370 | 10/1960 | Weibolt | 47/67 |
| 3,039,599 | 6/1962 | Mintz | 47/67 |
| 3,775,903 | 12/1973 | Pike | 47/37 |
| 3,818,633 | 6/1974 | Sable | 47/67 |
| 3,990,179 | 11/1976 | Johnson et al. | 47/35 |
| 4,329,812 | 5/1982 | Carlisle | 47/59 |
| 4,592,166 | 6/1986 | Tendrup et al. | 47/67 |
| 4,614,056 | 9/1986 | Farkas | 47/67 |
| 4,771,573 | 9/1988 | Stengel | 47/67 |
| 5,020,274 | 6/1991 | Wong | 47/67 |
| 5,088,234 | 2/1992 | Wong | 47/67 |
| 5,287,969 | 2/1994 | Kehr | 206/583 |
| 5,303,506 | 4/1994 | Weder et al. | 47/67 |
| 5,360,193 | 11/1994 | Cobb | 248/318 |
| 5,509,232 | 4/1996 | Laubsch | 47/79 |
| 5,706,604 | 1/1998 | Yogi | 47/65.5 |

*Primary Examiner*—Michael J. Carone
*Assistant Examiner*—Fredrick T. French, III

[57] ABSTRACT

An element for a plant container is disclosed that easily attaches to a flower pot. The element adjusts to different sizes and accommodates different hanging arrangements. The element is partially transparent and has spouts that allow controlled and spill-free watering and continuous monitoring of the plants' watering status.

18 Claims, 4 Drawing Sheets

ELEMENTS FOR A PLANT CONTAINER

FIELD OF THE INVENTION

This invention relates to a flower pot assembly and in particular to an improvement in the watering and monitoring arrangement of plant containers.

THE PRIOR ART

Plants in conventional flower pots, particularly those provided for hanging plants are normally watered pouring water onto the top of the soil. In outdoor situations rain might contribute to this arrangement. Some flower pots are provided with drainage holes in the container and have an attached bottom tray, taking typically 15% of the total heights. For esthetic reasons these trays generally blend into the convex or conical contour of the pot, revealing only a crack of about ⅛ of an inch to allow overflow from the reservoir of the attached or integral bottom tray. Watering the plants is usually effected by adding liquid to the top of the soil until excess water starts to escape from the top of the bottom tray. Water might continue to pour from this slit between the pot and drain dish, because excess water was temporarily retained or absorbed by the soil and then subsequently released. Also, in the interval between waterings, the potting soil has a tendency to shrink and developed cracks through which water will quickly percolate, descend and overflow the reservoir tray without fulfilling the potential of the watering process. This excess water that was destined to be later re-absorbed by capillary action upwardly into the soil chamber spills onto any surface that is below the flower pot, be it a window sill or a floor. Such excess liquid coming through the potting soil always carries dissolved matter, staining the surfaces below. For indoor applications this is an objectionable feature, but even outdoors during the summer, it might create unsightly spots on meticulously maintained floors. In autumn it is the custom of many gardeners to move potted plants indoors for the winter season and the natural watering has then to be done manually. Because heated air has a much lower relative humidity than the ambient atmosphere, this indoor watering has to be done rather frequently. A 10" pot with Spider plants for example might evaporate a quart of liquid every three days. Of course, many hobby gardeners consider this caring for their plants as a pleasure rather than a chore, but the process is always wrought with the risks outlined above.

To overcome the disadvantages of these situations, some of the prior art teaches the use of reservoirs and slowly feeding the liquid by capillary action through the porous wall of a clay pot as is seen in U.S. Pat. No. 2,629,204 to Dodds. In the U.S. Pat. No. 4,083,146 to Brankovic' is seen an example of a watering system using the action of a wick to obtain and control the flow of liquid from the reservoir to the plants. The use of a hidden, adjustable valve to regulate water flow is taught by Longacre in U.S. Pat. No. 2,885,825. U.S. Pat. No. 5,671,562 to Fah shows an example of a water metering system using flow control by means of a float. The use of a sealed container holding a partial vacuum and a porous medium to moderate the water flow is taught by Cloud in U.S. Pat. No. 3,192,665. Potochnik in U.S. Pat. No. 5,491,928 disclosed a flowerpot assembly wherein the inner and outer shells are both adapted to be held together and sealed by an annular lug and lip arrangement. None of these prior art patents show in their illustrations the use of transparent or translucent materials.

It is evident therefore, that many of the devices of the prior art, although ingenious and providing automatic watering control, are too complicated and too costly to have seen broad market appeal.

SUMMARY OF THE INVENTION

It is the objective of the present invention to provide a simple, inexpensive element for a plant container that enhances the pleasure of home gardening.

A further objective of the invention is to make possible easy and instant assessment of the watering condition in the plant container while perusing the beauty of the plants.

Another objective of the invention is to provide synergistically to the above advantages a means whereby the volume of stored water can be monitored during the watering process.

An additional objective of the disclosed invention is to synergistically prevent any overflow of liquid and spill and subsequent soiling of surfaces below a flower pot.

A principal objective of the invention is to provide an element for a plant container that is specially adapted to be easily suspended with all existing flowerpots without modifying their configuration.

It is another objective of the invention to provide an element for a flower pot that synergistically provides means for adjustments in size, adaptation to various suspension configurations , water replenishing means and lateral growth openings.

A further principal objective of the invention is to provide an element for a plant container that snaps easily into place for conversion from outdoor to indoor use.

Another objective of the invention is to provide an easy to replace and clean, esthetically attractive cover for plant containers, allowing also for changes in decor without replanting the vegetation.

Other objectives and advantages of the present invention will become apparent from the its' detailed description.

DESCRIPTION OF THE INVENTION

The present invention is predicated on the fact that home or hobby gardeners greatly enjoy the visual aspect as well as some of the work involved in their endeavor. To always know the moisture content of the soil is a principal concern in plant care. The present invention is also compatible with the fact that in planting soil that has a moisture gradient from soggy at the bottom to dry at the surface, both swamp plants and desert varieties can be cultivated, because each species will form roots to a depth that suit its watering needs. The disclosed element For a plant container has therefore no need for sophisticated metering devices. The disclosed element allows synergistically to ascertain the watering status of the plants while enjoying their beauty, and also to efficiently replenish their liquid levels without risk of spillage. Besides this utilitarian aspect, the inexpensive and instantly exchangeable element can, by incorporating different patterns and colors, also be used to create designer effects in home gardens.

In one aspect of the invention there is provided an element for a plant container that has a translucent and watertight wall portion and is adapted to accent a flower pot of the prior art in a loose fit and has means to be suspended in conjunction with the flowerpot.

In another aspect of the invention the element for a plant container has lips or flaps to suspend the element from the prior art flower pot.

In a further aspect of the invention, portions of the rim of the element for a plant container are curling inwardly and have a compound curvature, with the bottom of the element having a resilient bottom.

In another aspect of the invention the rim of the disclosed element for a plant container has a flat portion extending in the plane of the rim, a curved flap adjoining the rim and possibly also including a resilient bottom.

In a further aspect of the invention the prior art flower pot has three or more hanging attachments and the lips or flaps of the disclosed elements are dimensioned to bypass the attachment points of the hangers.

In another aspect of the invention the rim of the element is provided with at least one spout, this spout also forming the gap between the lips to accommodate the hangers of the flower pot In a further aspect of the invention the spout of ate element for a plant container synergistically serves to allow adjustment of the diameter of the element.

In another aspect of the invention the element for a plant container has apertures that allow plants growing from lateral holes of the first flowerpot to pass the exterior.

In a further aspect of the invention she apertures for the plants growing from the first pot are adapted to synergistically serve as filling or emptying spouts.

In another aspect of the invention the apertures for entering water are selectively positionable by the removal of sections of the wall of the element that are scored or weakened.

In a further aspect of the invention the heights of the water level in the interior of the element can be controlled by selecting the heights of removable aperture covers.

In another aspect of the invention the element for a plant container is suspendable from the hangers of the flower pot of the prior art.

In a further aspect of the invention the suspension means of the element of a plant container are adapted and dimensioned to be strong enough to support it and its contents.

In another aspect of the invention the suspension means for the element pass under its' bottom to fully take the combined load.

BRIEF DESCRIPTION OF THE DRAWINGS

The present invention is illustrated by way of example in the following drawings, wherein.

DESCRIPTION OF THE PREFERRED EMBODIMENTS

Figure 1:
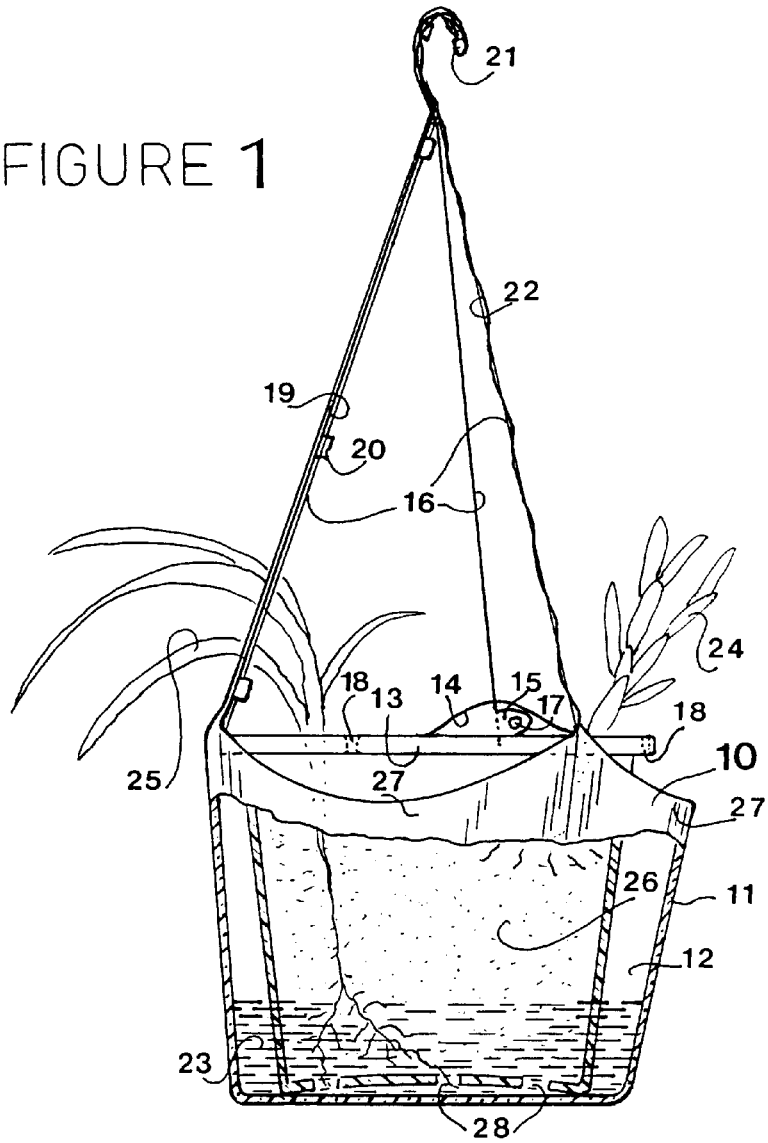
FIG. 1 shows an element for a plant container in partially sectioned perspective side view.
Figure 4:
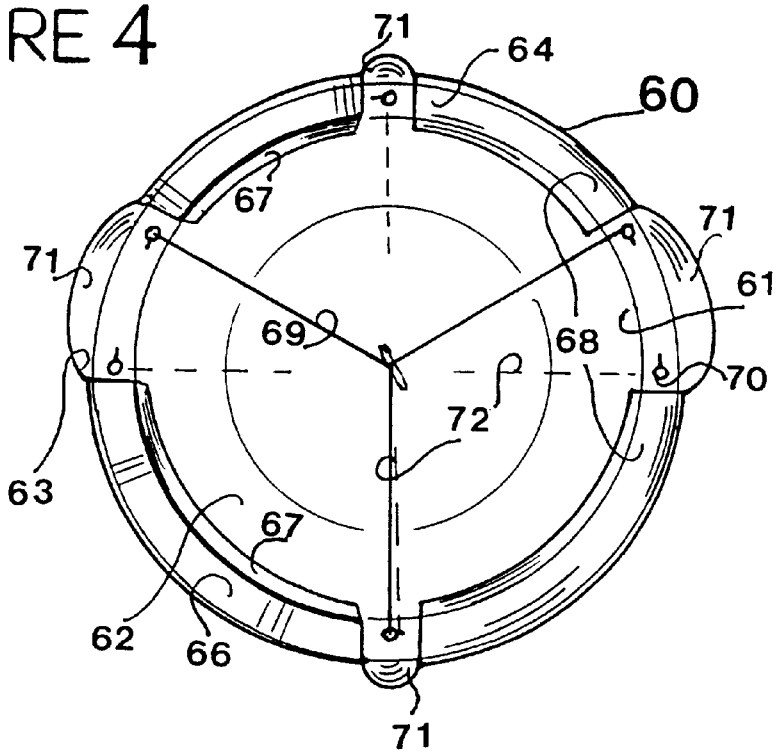
FIG. 4 shows a top view of an element for a plant container.
Figure 5:
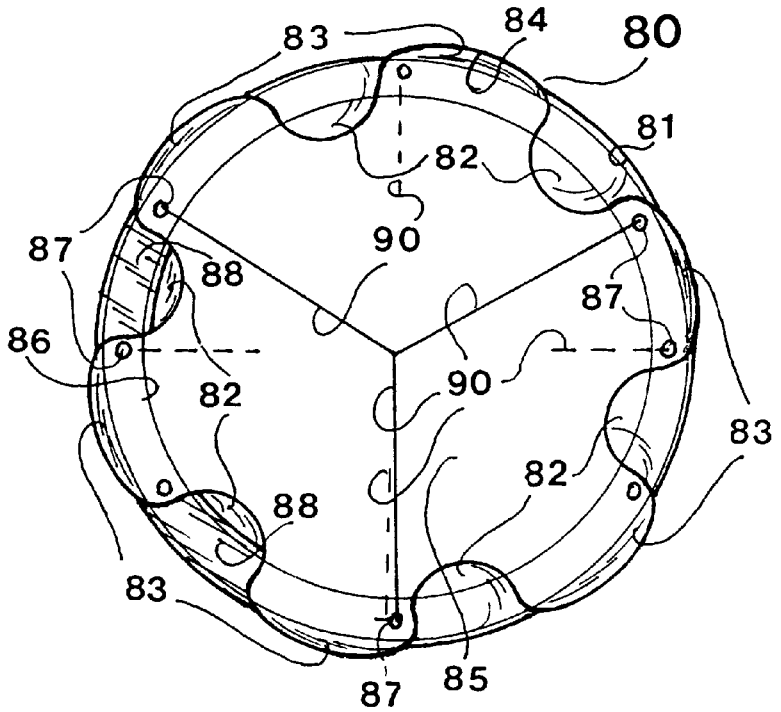
FIG. 5 is another top view of an element for a plant container and FIG. 6 is a side view of an element or a plant container.

Referring now in detail to the drawings:

FIG. 1 shows the outer element for a plant container 10 with transparent wall portion 11 that defines an interior space 12. A flowerpot or first plant container 13 seen in loose, non-sealing fit partially enclosed in element 10. On its' upper rim 14 is disposed a suspension means in the form of one of flaps 15 that is seen to reach first toward interior space 12 and is adapted to then attach to hanger 16 of flower pot 13. Lip 15 partially surrounds hanger 16 and is seen to be secured against opening and deflection by use or hole 17. This hole might be the means for tying flap 15 by a cord or wire or to introduce a snap arrangement (all not shown). Thus the suspension means 15 is securely attached to the hanging means 16 and serves to support the element 10 and its contents against gravity in conjunction with first container 13. Hangers 16 with their common too hooks are used to suspend the assembly of element 10 and flowerpot 13 from a ceiling hook, bracket or the like. Another embodiment of the suspension means of element 10 is shown as wire or plastic strand 19, that is disposed on rim 14 to align with hangers 16 and might be secured there by optional clips 20 and cap 21. Wire or filament 19 might be looped, under or incorporated into, the wall portion 11 to fully support the total weight of the content of interior space 12. An alternate embodiment of a suspension means for element 10 is the use of filament or wire 22 that is adapted to align with hangers 16 or the holes 18, to which it could be tied. This kind of suspension means would be very fitting for the version of flower pot 13 with four hangers 16, since a filament 22 of sufficient length could be simultaneously wound in clockwise and anti-clockwise spirals around opposing hangers 16, to culminate in the upper hook area. It is obvious that wires 19 and filaments 22 can supplement and strengthen and even replace missing, weakened or broken hangers 16 of the flower pots of the prior art. Flower pots 13 of different manufacturers have usually three or four hangers 16 and FIGS. 4 and 5 give a detailed view of various spacings of lips 15, wires 19 or filaments 22 that are preferred embodiments of the suspension means for element 10. Water 23 is seen to be maintained at a desired high level in interior space 12 and is always verifiable through the translucent and water tight lower wall portion 11. Plant 24 is seen to spread its roots near the dry surface of soil 26, in accordance with that particular species' preference. Vegetation preferring swampy conditions such as plant 25 is shown to have deeper roots reaching well into the soil 26 and water 23. It can be seen from this description that the flower pot 13 quickly and easily fits into interior space 12. Water 23 can be replenished through the top of soil 26 or through one or more spouts or bulges 27 that are formed by a section of wall 11 at rim 14 that is seen at these points to extend away from interior space 12. Excess of this water thus introduced is caught in interior space 12 and can be observed through the transparency as it is retained inside wall 11. In either case, no discoloring liquid should spill from aeration holes 28 of the prior art first plant container 13. Such overflow always resulted in marring the surfaces below. Thus, synergistic to the fast assembly, is the retention of excess water, the feature of instant monitoring of the level of water during the watering process and later, easy verification of the rate of evaporation. A synergistic feature of spouts 27 is that they, by virtue of their inherent flexibility, also serve to adjust the size of rim 14 so as to fit the various possible diameters of flower cot 13. This action will occur as the rim 14 contract toward interior space 12 under the pull of gravity on lips 15 or wires 19 or filaments 22. The loose and non-sealing fit between rim 14 and pot 13 and the opening of spouts 27 assures that water 23 evaporating from interior space 12 contributes to the humidity of the ambient air surrounding plants 24 and 25. Capillary action is also observed to moisten the rest of the soil 26 Lo some extend, as water is drawn upward, particularly in heated interiors with their typical low relative humidity levels.

Figure 2:
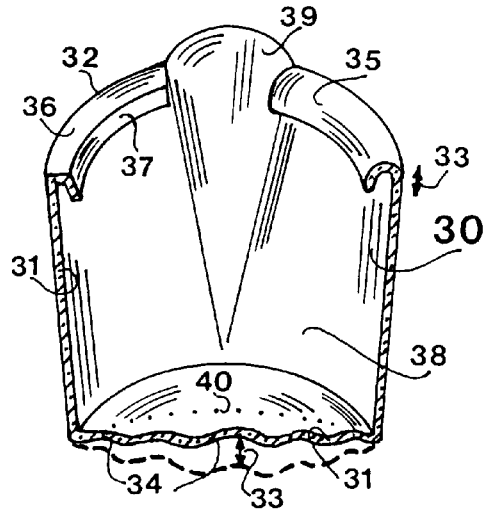
FIG. 2 shows a plant container in sectioned perspective side view.

In FIG. 2 is shown the element for a plant container 30, with transparent wall 31 and upper rim 32. The lower portion 33 is watertight and has circular undulations 34 that render the lower portion 33 flexible and resilient and adapted to yield in a direction away from upper rim 32. For illustrative convenience, rim 32 is shown with two versions of the element' suspension means, namely compound curvature lip segment 35 and the combination of the rims' flat portion 36 and lip 37. Segments 35 and 36 have in common that their configuration results in a relatively rigid structure that does not permit bending through a ninety degree angle as is the case with the relatively narrow lips 82 of the embodiment shown in FIG. 5. However, the lip segments 35 and 37 are adapted by use of the bulging spout 39 to yield enough laterally or away from interior space 38 to let pass between them a pot of the prior art (not shown). To allow such planting pot to bypass lips 35 and 37 and clear them completely in heights, the bottom wall portion 31 is adapted by use of undulations 34 to flex at least through the distance indicated by arrow 33. This distance is equivalent to the length of lips 35 and 37 as they project from rim 32 toward interior space 38. A further and alternate upward curvature of bottom portion 33 is shown in pointed line 39 to illustrate how this particular embodiment synergistically allows easy snapping-on of the element 30 and also its' adaptation to different heights of flower pots of the prior art. The various configurations of lips 35 and 37 are shown in detail in FIGS. 4 and 5, where three or four hangers are seen to be accommodated in the gaps formed the various lips or flaps of the preferred embodiments. However, even when used in conjunction with a prior art flower pot that has no hangers, the synergistic advantages of the present invention are evident in that it 1) allows the quick assembling of the disclosed element and the prior art plant pot; 2) allows the assemblage to be lifted, suspended and moved together without water spillage from an open lower tray; 3) allows controlled spill-free watering and also 4) easy visual monitoring of the water level.

Figure 3:
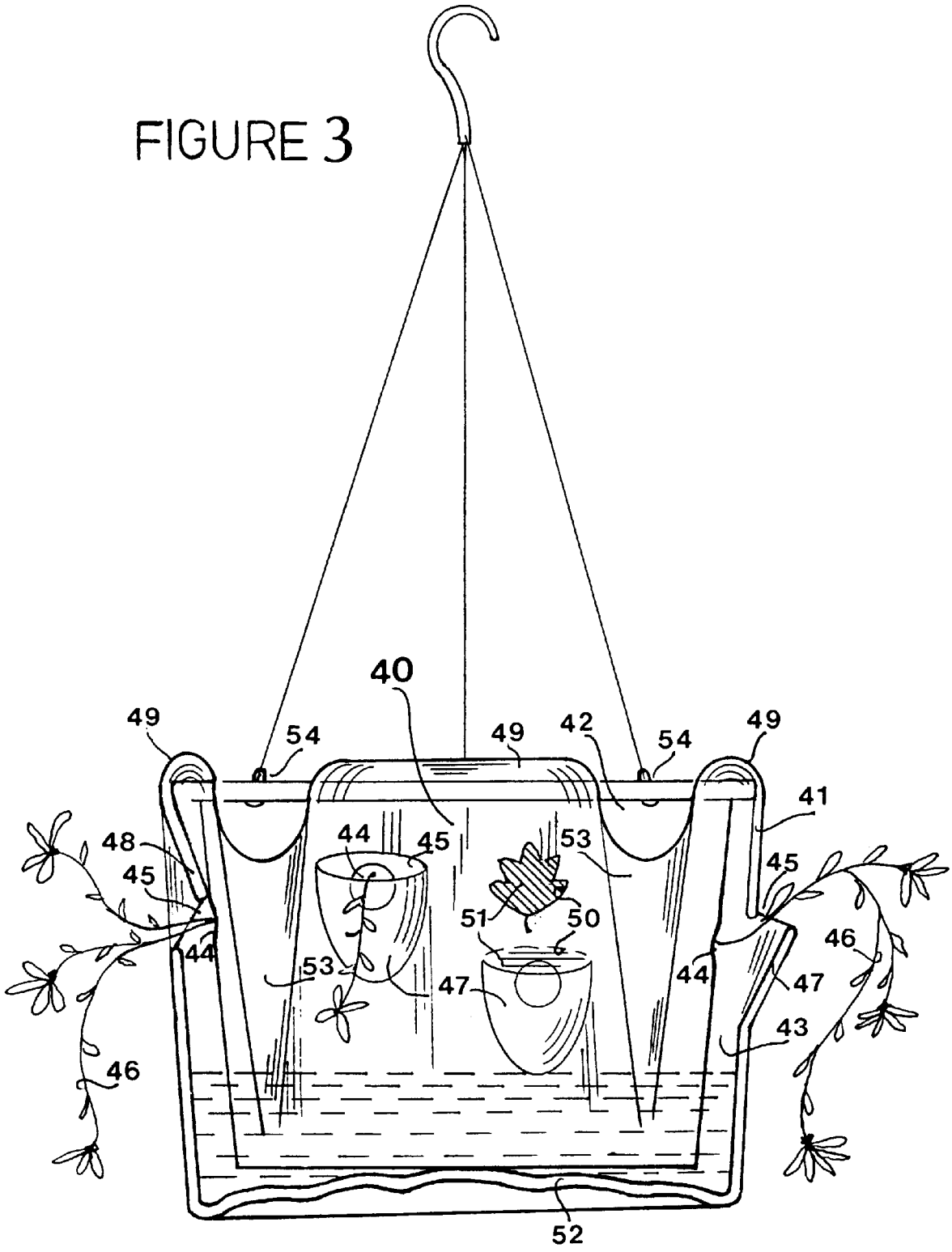
FIG. 3 shows the side view of an element for plant container holding a flower pot.

In FIG. 3 is shown element for a plant container 40 that has transparent wall portion 41 through which is visible a first plant container 42 that is loosely held in interior space 43. Flower pot 42 has lateral openings or holes 44 through which plants 46 are seen to grow. These are destined to form a desired sphere-shaped flower arrangement. To accommodate this configuration, element 40 is provided with apertures 45 that are placed to align with holes 44. Plants will obviously grow through openings 44 and apertures 45 even if the two are not perfectly aligned. This fact will allow for variations in the position of holes 44 in pots 42 of different manufacture. Some of apertures 45 are seen to be adapted to synergistically serve as watering spouts 47. These spouts or bulges 47 of wall portion 41 are seen to extend away from the interior space 43. The apertures 45 of spouts 47 can be expanded slits that are opened when bulge 47 is formed. An alternate embodiment of these apertures 45 is shown as depression 48 in the transparent wall portion 41. Indentations 48 are formed by molding a part of wall 41 in a shape that bulges inwardly toward the interior space 43. Liquid can be introduced through apertures 45 near spouts 47 or depression 48. An attractive variant of element 40 is to make the location of these apertures selective by working non-penetrating creases or scorings 50 into the wall portion 41 at prospective designated locations of apertures or spouts, and allow the user to press out the removable portions 51 that are fitting a particular location or openings 44. The shape of the spouts 47, scorings 50 for the apertures 45, the rim segments 49 and other components of element 40 or of any other embodiments can be shaped in motives or patterns teat enhance the appearance of the disclosed elements. Such decorations might be replicas of plant themes or patterns or colors in fashion. One such decorated component is the upper, leaf-shaped cover 51 that has a green opaque color and could be removed to leave a leaf-shaped aperture 45. The lower scored section 51 is also shown not removed, but has the potential to be made into an aperture 45. It is apparent that for outdoor use in uncontrollably rainy conditions, apertures 45 can be selectively created by use of scored sections 51 that are so positioned on wall portion 41 so as to limit the level of water in interior space 43.

In FIG. 4 is shown a preferred embodiment of an element for a plant container 60, wherein first plant container 61 is held in conjunction with element 60 in its' interior space 62. The transparent wall portion 63 is formed into upper rim 64 that can have a flat portion 66 with adjacent flap 67, or a compound curve lip or flap 68. The original flower pot 61 has a three part hanging means or hangers 69 that are seen to project away and upward from the central cavity of flower pot 62. Further attachment holes 70 are often provided on the prior art pots 61 to fit a four-part hanger arrangement 72 shown in broken lines. Bulges or spouts 71 are seen to be part of rim 64 and wall 63 and extend away from interior space 62. It can be seen that spouts 71 align with the three hangers 69 but also accommodate the four attachment holes 70 for the four alternate hangers 72 of flower pot 61. These spouts or bulges 71 serve at least four synergistic functions: to provide yielding gaps between he rather rigid segments or lips 67 and 68 so as to temporarily increase the diameter of rim 64 and thereby allow passage of sot 61; to provide breaks in rim 64 that will accommodate both hangers 69 and the alternate four-point hanging means 72; to serve by virtue of their flexibility as a means to adjust the diameter of rim 64 so as to fit different sizes of flower pot 61; and to serve as spouts for introducing into, or removing water from, element 60. These configurations of the hanging means 69 and 72 of the prior art result admittedly in an asymmetrical division of the lips 67 and 68 as well as spouts 69. However, since only one half of element 60 is visible at any one time and plants by their nature are somewhat uneven, no serious objection to the looks of element 60 are foreseen. This effect can be further camouflaged by the judicious use of decorations already outlined before. Other divisions of the rim 64 into 5 or more stiff segments and flexible spouts is possible.

FIG. 5 shows a different example, where the upper rim 84 of wall 81 of element for a plant container 80 is seen divided into sixteen smaller sections, giving eight lips or flaps 82 and eight spouts or bulges 83. Element 80 encloses a first flower pot 84 contained by interior space 85. Lips 82 are seen to project inwardly toward interior space 85. Marked on flower pot 86 are attachment holes 87 that serve to accept the hanging means 90. These are either a three-part hanger or the four-stranded hanger shown in broken lines. The bulges or spouts 83 are seen to bypass and accommodate, and to be substantially aligned with, these seven attachment holes. Spouts 83 that are formed by sections of wall 81 that extend away from the interior space 85, and serve the four synergistic functions previously outlined. The lips 82 are relatively narrow, not more than two inches wide for an element 80 that is made to hold a ten inch flowerpot 86. Because of this small width, any compound curvature of lips 82 is not an impediment to bending them easily. Similarly, the crease at the junction between flaps 82 and flat portion 88 of rim 84 should not hinder the lifting up of flaps or lips 82 to allow insertion of flower pot 86. The added feature of a resilient and height-adjusting bottom of wall portion 81 is available, but not visible in this illustration.

Figure 6:
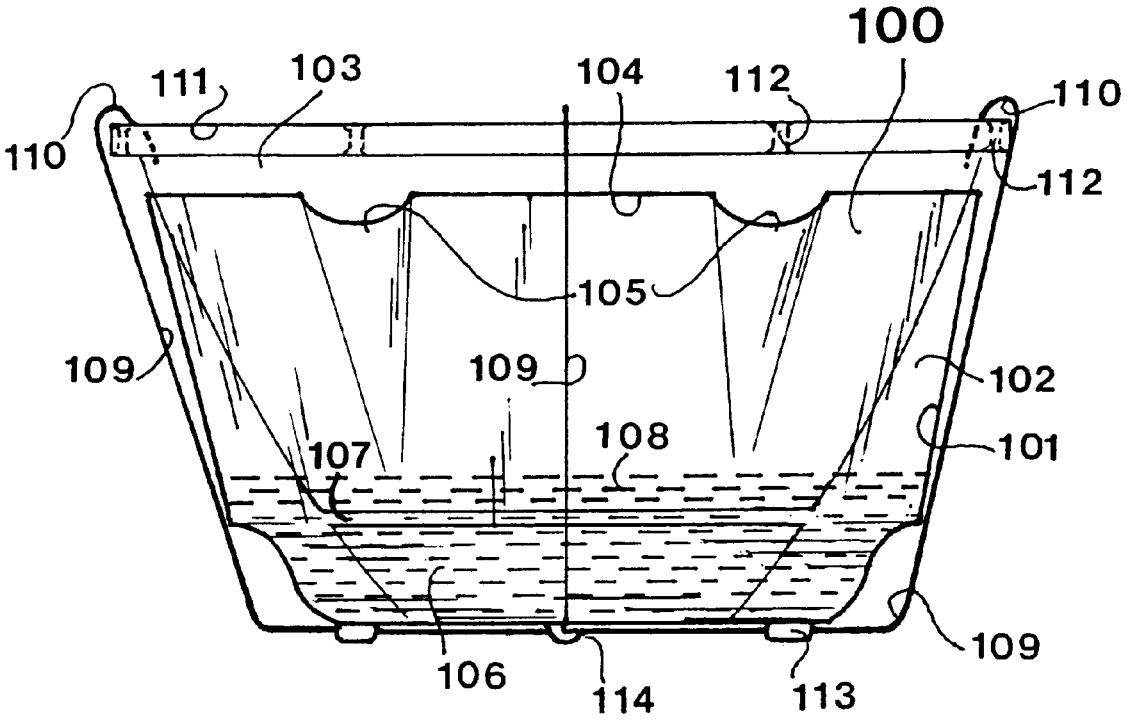

In FIG. 6 is seen element for a plant container 100 that has a transparent wall 101 and partially encloses within interior space 102 the flower pot 103 of the prior art. The spouts 105 are formed by a flexible bulge of wall portion 101 that is seen to extend away from interior space 102. The size of spouts 105 varies as the rim 104 slides up and adjusts to the increasing diameter of the tapering side of not 103. flower pot 93 also has a conventional holding tray 106 and spill gap 107, through which water 108 is now fed into the pot 103. A wire bow or clamp 109 is the suspension means whereby element 100 is supported in conjunction with flower pot 103 during transport or when hung on a support. The wire clamp 109 are adapted to connect to the flower pot 103 by hooks 110 that reach over upper edge 111 and into the central cavity of the pot 103. Hooks 110 can also engage the attachment holes 112 that might be provided on pot 103. Protrusions 113 on the watertight lower portion of wall 91 allow wire bow 109 to snap into place and to be retained against lateral slippage. These protrusions 103 could be provided with a lip or hole 114 that could positive engage and enclose the wire loop 109. The wire of bows 109 could obviously be replaced by a filament or cord that is tightly tied through the holes 112 or around its' adjoining hangers. Bumps 113 also serve as legs to keep wire 109 and wall portion 101 off any surface on which element 100 might be placed. Like the wires 19 or filaments 22 of the embodiment shown in FIG. 1, the suspension means of element 100, namely wire or filament 109 are understood to be made strong enough to support the weight of element 100 and the content of interior space 102.

Those skilled in the art are knowledgeable in the choice and composition of thermo-plastic, opaque and translucent polymer materials suitable for the various components of the disclosed invention. Similarly, the details of tooling designs and other related information has been omitted, because these too are well known to those skilled and working in the art.

The preceding illustrations are but examples of the several possible embodiments, and the present invention shall be considered to be defined by the following claims.

What is claimed is:

1. An element for a plant container, said element having a wall portion defining an interior space, said wall portion having an upper rim, said wall portion dimensioned so as to at least partially enclose a first plant container in a loose or non-sealing fit, said first plant container defining a central cavity, said element having a lower portion that is impervious to water, said element comprising at least one transparent or translucent portion, said element comprising at least one suspension means that is adapted and dimensioned to suspend said element in conjunction with said first plant container and substantially maintain contact or close proximity between said lower portion and said first plant container, said suspension means adapted and dimensioned to attach to said first plant container without disassembly of said first plant container, said wall portion and upper rim comprising at least one spout or open bulge that exposes at least a portion of said first plant container, said spout extending in a direction substantially away from said interior space so as to create an opening between said first plant container and said wall portion, said opening adapted for the entering or removal of liquid from said element, said spout comprising a resilient material and being adapted and dimensioned to selectively expand away from said interior space so as to produce an expansion of said upper rim, or to selectively contract toward said interior space so as to produce a contraction of said upper rim.

2. An element as in claim 1 wherein said lower portion of said element is adapted to be resilient and to be adjustable in the dimension toward said upper rim and also away from said upper rim and wherein said lower portion is strong enough to carry without being deformed the weight of said first plant container.

3. An element as in claim 1 wherein said suspension means is adapted and dimensioned to pass outside and below said lower portion and wherein said suspension means is adapted to connect to said first plant container and wherein said lower portion is adapted to prevent slippage of said suspension means.

4. An element as in claim 1 wherein said spout or bulge is disposed on said rim so as to substantially align with the hanging means of said first plant container.

5. An element as in claim 1 wherein said suspension means is adapted and dimensioned to support the weight of said element and the content of said interior space.

6. An element for a plant container as in claim 1 wherein said wall portion comprises at least one decorative motif.

7. An element as in claim 1 wherein said first wall of said first plant container has first openings or holes provided for the sideways growth of plants, and wherein said wall portion of said element comprises apertures dimensioned and positioned to substantially align with said first openings, said apertures dimensioned and adapted to permit plants growing from said first openings to grow through said apertures of said element.

8. An element as in claim 7 wherein said wall portion adjacent to at least one of said apertures extends away from said interior space so as to form a spout or bulge suitable for entering and removing liquid from said element.

9. An element as in claim 1 wherein said wall portion adjacent to at least one of said apertures extends inward toward said interior space to form an indentation facilitating the entering of liquid from said element.

10. An element for a plant container as in claim 7 wherein said wall portion has non-penetrating scores or indentations that outline areas of said wall portion that can be selectively removed by breaking said wall portion along said scores or indentations and wherein said areas will form said apertures.

11. An element as in claim 1 wherein said suspension means is adapted to suspend said element from said first plant container, and wherein said suspension means is disposed at said upper rim and wherein said suspension means comprises at least two lips or flaps made from a resilient material and wherein said lips or flaps extend substantially toward said interior space.

12. An element as in claim 11 wherein said lips or flaps comprise a compound curvature portion and wherein said lower portion of said element is adapted to be resilient and to temporarily yield in a direction substantially away from said upper rim.

13. An element as in claim 12 wherein said first plant container has hanging means projecting substantially away from said central cavity and wherein the lips or flaps of said suspension means are dimensioned and spaced on said rim in a manner so as to bypass the hanging means of said first plant container.

14. An element as in claim 11 wherein said upper rim comprises a substantially flat portion extending toward said interior space and wherein said lips or flaps are disposed on said flat portion in a direction toward said interior space and wherein said lower portion of said element is adapted to be resilient and to temporarily yield in a direction away from said upper rim.

15. An element as in claim 14 wherein said first plant container has hanging means projecting substantially away from said central cavity and wherein said flat portion and also said lips or flaps are adapted and dimensioned to bypass said hanging means.

16. An element as in claim 11 wherein said first plant container has hangers or hanging means projecting substantially away from said central cavity and wherein the lips or flaps of said suspension means are dimensioned and spaced on said rim in a manner so as to bypass the hanging means of said first plant container.

17. An element as in claim 1 wherein said suspension means is dimensioned and adapted to be attachable to the hanging means of said first plant container.

18. An element for a plant container as in claim 1 wherein said wall portion comprises apertures that are adapted and placed at selected distances from said lower portion so as to selectively limit the level of water inside said interior space.

* * * * *

UNITED STATES PATENT AND TRADEMARK OFFICE

CERTIFICATE OF CORRECTION

PATENT NO. : 6,073,393

DATED : June 13 2000

INVENTOR(S) : Gunter E. Gutsche

It is certified that error appears in the above-identified patent and that said Letters Patent is hereby corrected as shown below:

| | | | | |
|---|---|---|---|---|
| column 2, | line 48 | change "For" | to | -for- |
| column 3, | line 14 | change "pot" | to | -pot. - |
| | line 15 | change "ate" | to | -the- |
| | line 22 | change "she" | to | -the- |
| column 4, | line 10 | change "too" | to | -top- |
| | line 35 | change "water" | to | - water- - |
| | line 58 | change "cot" | to | -pot- |
| | line 65 | change "Lo" | to | -to- |
| column 5, | line 7 | change "element' " | to | -elements'- |
| column 6, | line 1 | change " teat" | to | -that- |
| | line 18 | change "three" | to | -three- - |
| | line 30 | change "sot" | to | -pot- |
| | line 44 | change " is" | to | -are- |
| column 7, | line 7 | change " flower" | to | -Flower- |
| | line 13 | change "are" | to | -is- |

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*